US009391360B1

(12) United States Patent
Bayram et al.

(10) Patent No.: US 9,391,360 B1
(45) Date of Patent: Jul. 12, 2016

(54) ANTENNA AND METHOD FOR OPTIMIZING THE DESIGN THEREOF

(71) Applicant: PaneraTech, Inc., Chantilly, VA (US)

(72) Inventors: Yakup Bayram, Falls Church, VA (US); Wladimiro Villarroel, Lewis Center, OH (US); Alexander Ruege, Centerville, VA (US); Eric Walton, Columbus, OH (US)

(73) Assignee: PANERATECH, INC., Chantilly, VA (US)

( * ) Notice: Subject to any disclaimer, the term of this patent is extended or adjusted under 35 U.S.C. 154(b) by 281 days.

(21) Appl. No.: 14/252,975

(22) Filed: Apr. 15, 2014

Related U.S. Application Data

(60) Provisional application No. 61/812,366, filed on Apr. 16, 2013.

(51) Int. Cl.
*H01Q 1/50* (2006.01)
*G06F 17/50* (2006.01)
*H01Q 1/24* (2006.01)

(52) U.S. Cl.
CPC ..... *H01Q 1/242* (2013.01)

(58) Field of Classification Search
None
See application file for complete search history.

(56) References Cited

U.S. PATENT DOCUMENTS

| | | | | |
|---|---|---|---|---|
| 5,872,542 | A | 2/1999 | Simons et al. | |
| 6,384,790 | B2 | 5/2002 | Dishart et al. | |
| 7,205,947 | B2 | 4/2007 | Parsche | |
| 7,233,296 | B2 | 6/2007 | Song et al. | |
| 7,427,961 | B2 * | 9/2008 | Song | H01Q 1/1271 343/711 |
| 7,675,466 | B2 | 3/2010 | Gaucher et al. | |
| 7,983,721 | B2 | 7/2011 | Ding et al. | |
| 8,279,131 | B2 | 10/2012 | Puzella et al. | |
| 8,299,967 | B2 | 10/2012 | Xu et al. | |
| 8,424,769 | B2 | 4/2013 | Kato | |
| 8,634,764 | B2 | 1/2014 | Cruz et al. | |
| 8,749,438 | B2 | 6/2014 | Jenwatanavet et al. | |
| 8,766,856 | B2 | 7/2014 | Hsieh et al. | |
| 2002/0152606 | A1 | 10/2002 | Huang | |
| 2006/0009251 | A1 | 1/2006 | Noda et al. | |
| 2007/0040746 | A1 | 2/2007 | Song et al. | |
| 2007/0287503 | A1 | 12/2007 | Ying et al. | |
| 2009/0267839 | A1 | 10/2009 | Liao et al. | |
| 2011/0156967 | A1 | 6/2011 | Oh et al. | |
| 2011/0273382 | A1 | 11/2011 | Yoo et al. | |
| 2012/0133597 | A1 | 5/2012 | Chen | |
| 2012/0162032 | A1 | 6/2012 | Yang et al. | |
| 2012/0287066 | A1 | 11/2012 | Yang et al. | |
| 2013/0059532 | A1 * | 3/2013 | Mahanfar | H04B 5/0031 455/41.1 |
| 2014/0139379 | A1 | 5/2014 | Bolin et al. | |
| 2014/0176819 | A1 | 6/2014 | Yilmaz | |

FOREIGN PATENT DOCUMENTS

| | | |
|---|---|---|
| WO | WO 2005/086277 | 9/2005 |
| WO | WO 2013/149514 | 10/2013 |

* cited by examiner

*Primary Examiner* — Dameon E Levi
*Assistant Examiner* — David Lotter
(74) *Attorney, Agent, or Firm* — Whiteford, Taylor & Preston, LLP; Gregory M. Stone

(57) ABSTRACT

Disclosed is an antenna system and method to optimize the design of an antenna using resistive sheets. The system and method are operative to design a topology of a resistive sheet to mitigate the adverse effects caused by the inherent losses of resistive sheets while operating as antennas. The system is designed to reduce a plurality of radiofrequency current "hot spots" and "pinch points," associated with the flow of a current on a resistive sheet, by a sufficient extent so as to enable radiation of electromagnetic waves at substantially higher radiation efficiency as compared with antennas designed using traditional design techniques.

18 Claims, 9 Drawing Sheets

ANTENNA AND METHOD FOR OPTIMIZING THE DESIGN THEREOF

CROSS REFERENCE TO RELATED APPLICATION

This application is based upon and claims priority from U.S. Provisional Patent Application Ser. No. 61/812,366 entitled "Planar Antenna and Design Method Thereof," filed with the U.S. Patent and Trademark Office on Apr. 16, 2013, by the inventors herein, the specification of which is incorporated herein by reference.

FIELD OF THE INVENTION

The present invention relates to antenna systems and methods. More particularly, the present invention relates to antennas made of resistive materials and antenna design and manufacturing methods for overcoming adverse effects caused by losses in such resistive materials.

BACKGROUND OF THE INVENTION

A number of resistive sheet or resistive layer antenna designs and systems exist within various industries for providing a partly conductive and at the same time optically transparent layer of material for multiple applications. The sheet resistivity and the light transparency of the resistive sheet are the key factors to determine the implementation of a resistive sheet antenna. In general, an antenna made of a resistive transparent sheet, such as Indium tin oxide, experience losses several orders of magnitude larger than an antenna made of a conductive material such as Copper or Silver. Therefore, antennas are primarily made of a conductive material, if possible. However, conductive materials are opaque to light. As a result, in certain applications requiring the use of a transparent antenna, a conductive material cannot be used.

In recent years, the demand for transparent antennas has increasingly grown for touchscreen, mobile platform, and automobile applications. In particular, the implementation of antennas, made of a transparent conductive layer, on the display window of a portable communication device have been addressed in the prior art, as described in U.S. Pat. No. 7,983,721 to Ding et al., the specification of which is incorporated herein by reference in its entirety. However, these efforts have faced certain challenges and limitations. Particularly, attempts made to provide an antenna design sufficiently transparent to light and at the same time capable of performing at radiation efficiency levels set up by industry standards have not been successful. A major challenge is that as the sheet resistivity of a resistive sheet increases, making the resistive sheet more conductive, the optical transparency of the resistive sheet decreases. Likewise, as the sheet resistivity increases, the power dissipated as heat as a result of currents flowing on the resistive sheet increases too. Accordingly, the radiated power and the radiation efficiency of the resistive sheet are reduced, making it very challenging for resistive sheet antennas to meet radiation efficiency industry standards.

Therefore, a compromise is required between two conflicting goals. Firstly, making the resistive sheet as conductive as possible, which means less transparent; and secondly, making the antenna more optically transparent, which means a more resistive sheet having a larger sheet resistivity. Current technology offers optically transparent resistive sheets having a sheet resistivity larger than 10 Ohms per square. However, for these values of sheet resistivity, standard designs techniques used for antennas made of conductive materials notably fail.

Moreover, in placing an antenna close to conductive or resistive materials, electromagnetic coupling between the antenna and these materials also contributes to power losses that decrease the effective radiated power at a system level. In most touchscreen and mobile platform applications, the antenna is surrounded by a number of conductive and resistive materials that must be considered, especially when designing an antenna using resistive sheets, to maximize the overall radiated power. Accordingly, manufacturers intending to use a resistive sheet on the touchscreen area as an antenna experience either an unacceptable reduction in radiation efficiency or an unacceptable performance of the touchscreen. This leads manufacturers to implementation of antenna system that are costly, aesthetically unappealing, or more importantly, highly inefficient.

Previous efforts have been made to develop a method of improving the radiation efficiency of antennas made of transparent resistive sheet, as described in U.S. Pat. No. 7,233,296 to Song, et al. However, this method is primarily aimed at determining values for current density over the surface of the resistive sheet to identify regions having concentrated flow of currents. Then the antenna efficiency is improved by increasing the conductivity in such areas of high current concentration.

The method described in the patent to Song et al., has also faced severe challenges and limitations. In particular, the resulting resistive layer will not be optically homogeneous. In other words, there will be areas of the resistive layer having darker spots resulting from the increased conductivity. Thus, although the resistive layers may meet optical transparency functional requirements, the resistive layer will not be aesthetically appealing. Furthermore, the manufacturing process used to provide different regions with different conductivity increases costs. Moreover, and more importantly, the areas of high-current concentration will vary depending on the type of application, the user operation, and the surrounding areas to the resistive sheet. Accordingly, small areas of higher conductivity on the resistive sheet may not cover a shift of the high-current spots. Alternatively, increasing the size of the areas of higher conductivity (darker areas) on the resistive sheet may further compromise the aesthetics and the optical transparency of the resistive sheet.

A way to approach the disadvantages of the efforts attempted by the prior art is to design a resistive sheet antenna, based on the topology of the resistive sheet. In this way, it is possible to increase the radiation efficiency of the antenna by identifying and mitigating or eliminating the sources of losses experienced by the antenna as current flows on the resistive sheet. In particular, a uniform radio frequency (RF) current distribution over the topology of the resistive sheet may prevent RF current "hot spots" and pinch points," resulting in substantial increase of radiation efficiency.

An RF current "hot spot" is characterized by a region of a material wherein a concentration of RF current is present having significantly larger current levels as compared to other regions having a more uniform current distribution and lower current levels. In particular, for a resistive sheet, a "hot spot" region dissipates a substantial amount of power as heat, significantly reducing the amount of radiated power.

Likewise, an RF current "pinch point" is characterized by a region of a material wherein the physical configuration of the material forces the RF current to converge creating high concentration of current levels. Thus, a narrow region of a material will have larger current densities as compared to a wider region of the same material. Accordingly, a "pinch point" in a resistive material will result in a substantial amount of power dissipated as heat, significantly reducing the amount of radiated power. Therefore, it is critical for a resistive sheet antenna to avoid RF current "hot spots" and "pinch points," in order to be able to radiate power and operate as an antenna.

Currently, there is no well-established method of deterministically creating a topology configuration of a resistive sheet to provide acceptable values of radiation efficiency, especially for resistive sheets having a sheet resistivity greater than 10 Ohms per square.

Thus, there remains a need in the art for antenna system designs and methods, using resistive sheets, capable of operating at radiation efficiencies that avoid the problems of prior art systems and methods.

SUMMARY OF THE INVENTION

An antenna system and method of optimizing the design of an antenna using resistive sheets, or equivalently resistive layers, is disclosed herein. One or more aspects of exemplary embodiments provide advantages while avoiding disadvantages of the prior art. The system and method are operative to design a topology of a resistive sheet to mitigate the adverse effects caused by the inherent losses of resistive sheets while operating as antennas. The system is designed to reduce a plurality of RF current "hot spots" and "pinch points" associated with the flow of a current on a resistive sheet, by a sufficient extent so as to enable radiation of electromagnetic waves at a substantially higher radiation efficiency as compared with antennas designed using traditional design techniques.

An antenna system using a resistive sheet designed according to the method described herein is able to uniformly distribute the currents flowing on said resistive sheet to reduce power losses as heat. Accordingly, more power is radiated improving the radiation efficiency of the antenna system. This increased radiation efficiency is primarily dictated by the resistive sheet topology that provides wide areas and smooth edges wherein current flows to yield a more uniform current density distribution over the resistive sheet. In addition, wide areas of the resistive sheet contribute to prevent RF current "pinch points," while smooth edges contribute to avoid RF current "hot spots," especially at contracted, corners, junctions, bends, periphery, or sharp regions of said resistive sheet, where significant RF power is dissipated as heat instead of being radiated.

The determination of the topology configuration of the resistive sheet is based on determining an effective alpha function, which depends on the physical dimensions of the resistive sheet and is proportionally related to the radiation losses of the resistive sheet. Thus, lower values of the effective alpha function translate into lower power losses as heat, and higher power available for radiation. The resistive sheet is discretized into pixels or cell units, and the effective alpha function is calculated for each pixel. Then circuit network theory is used to compute the effective alpha function for the entire resistive sheet structure. The values of the effective alpha function over the entire structure provides a key guidance to determine which areas of the topology must be adjusted to further improve the design and avoid any "hot spots" and "pinch points." Alternatively, electromagnetic simulation software may be used to compute the effective alpha function.

The method to design a resistive sheet antenna with significantly higher radiation efficiency as compared to standard techniques used to design an antenna made of conductive material includes the step of determining a reference effective alpha function for an initial topology that avoids RF current "hot spots" and "pinch points." The method further includes the steps of designing alternative antenna topologies of said antenna, wherein RF currents flow uniformly over as much area as possible of said antenna, reducing electromagnetic coupling between said antenna and other materials, and reducing RF current "hot spots" and RF current "pinch points" on other resistive material. The method further includes the step of selecting the antenna topology most suitable for the intended application of said antenna, in terms of performance or other predetermined criteria.

By significantly reducing the losses caused by currents flowing over a resistive sheet by means of determining a suitable topology of the resistive sheet and by increasing the uniform distribution of the current density flowing on the resistive sheet, the antenna system and method are able to provide outcomes that significantly increase the radiation efficiency, as compared to antenna designs using standard techniques. This increase in radiation efficiency may be multiple times larger, resulting in designs that meet or exceed challenging industry standards, in terms of antenna radiation performance and optical transparency, for a resistive sheet antenna.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
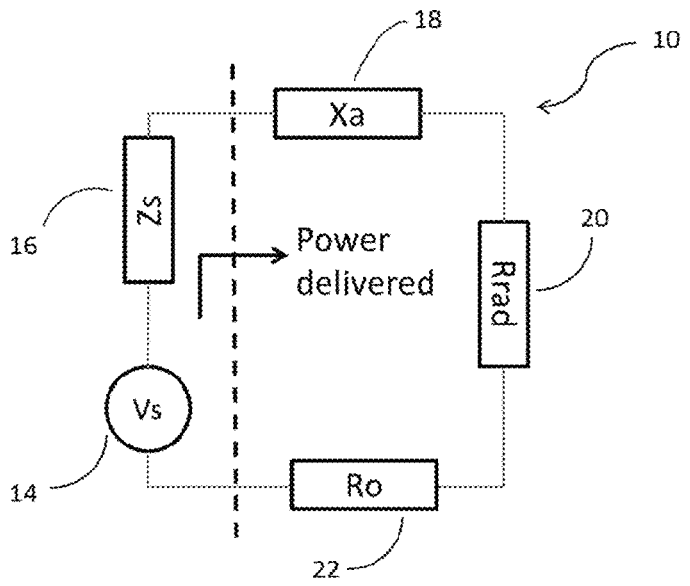
FIG. 1 shows a diagram of an equivalent circuit of an antenna in transmit mode.

FIG. 1 shows a schematic diagram of an equivalent circuit 10 of an antenna (not shown) in transmit mode. In transmit mode, the antenna is assumed to be attached to a voltage source 14 having a source internal impedance 16. The antenna is represented in circuit 10 by an antenna reactance 18 and an antenna resistance composed of an antenna radiation resistance 20 and an antenna loss resistance 22. In general, the antenna radiation efficiency accounts for losses within the antenna structure. For an antenna made of a resistive sheet or a resistive layer of material, the losses within the antenna structure are due primarily to conductive or ohmic losses caused by the power dissipated as electric current flows on the resistive sheet. The antenna radiation efficiency is defined as the ratio of the power delivered to antenna radiation resistance 20 to the power delivered to the total antenna resistance, which includes antenna radiation resistance 20 and antenna loss resistance 22. This means that the antenna radiation efficiency, e, can be written as:

$$e = \frac{R\text{rad}}{Ro + R\text{rad}}$$

where Rrad is antenna radiation resistance 20, and Ro is antenna loss resistance 22.

From the above expression of the antenna radiation efficiency, e, it is clear that either an increase of the value of antenna radiation resistance 20 or a decrease of the value of antenna loss resistance 22 will increase the antenna radiation efficiency, e. In particular, the radiation efficiency of an antenna can be significantly affected by the presence of a resistive material near the antenna. This is due to the electromagnetic coupling of energy between the antenna and the resistive material. The energy that is coupled into and dissipated by the resistive material cannot be further radiated, resulting in less effective power radiated by the antenna. The outcome is equivalent to having an antenna with larger antenna loss resistance 22. A number of factors affect the amount of electromagnetic coupling between an antenna and a nearby resistive material, including the dimensions and relative location of the antenna and the resistive material, the antenna polarization and operating frequency range, and the distance between the antenna and the resistive material.

Figure 2:
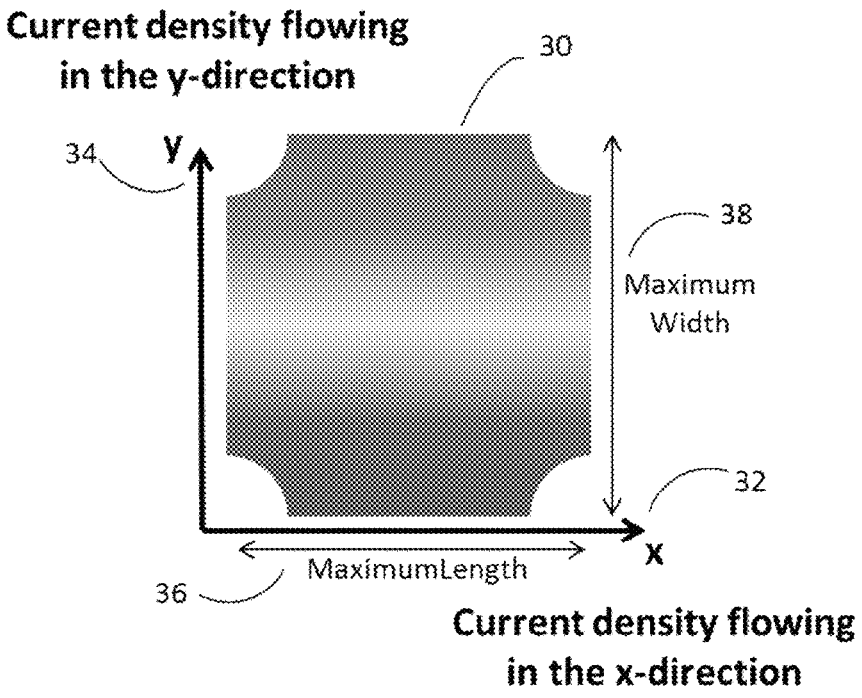
FIG. 2 shows a representation of a current density flowing on a resistive sheet.

FIG. 2 shows a representation of a current density flowing on a generic resistive sheet 30 having an arbitrary shape. In FIG. 2, resistive sheet 30 is characterized by a material having a maximum length 36, a maximum width 38, and a thickness. The thickness of resistive sheet 30 is several magnitudes smaller than maximum length 36 and maximum width 38. Resistive sheet 30 may be referred to using a Cartesian coordinate system consisting of an "X" axis 32 and a "Y" axis 34. Axes 32 and 34 are selected such that resistive sheet 30 lies in the plane defined by "X" axis 32 and "Y" axis 34 (the XY plane). The magnitude of the current density flowing on resistive sheet 30 is represented by a gray scale plot in FIG. 2, wherein different tonalitues of gray scale correspond to different magnitude levels of current density.

For resistive sheet 30 operating as an antenna element of effective length, $L_{eff}$, and effective width, $W_{eff}$, loss resistance 22 is given by the sheet resistivity, Rs, multiplied by the effective length-to-effective width ratio, i.e.:

$$Ro = Rs\frac{L_{eff}}{W_{eff}}$$

where effective length, $L_{eff}$, and effective width $W_{eff}$ correspond to the length and width of resistive sheet 30 where the current density is different from zero, respectively. Therefore, a current density uniformly flowing over the entire area of resistive sheet 30 will yield an effective length identical to the physical length of resistive sheet 30 and an effective width identical to the physical width of resistive sheet 30. Likewise, for a current density with non-uniform distribution on the entire area of resistive sheet 30, the effective length or the effective width will be smaller than the corresponding physical length or physical width of resistive sheet 30, respectively.

It is possible to introduce an effective alpha function, $\alpha_{eff}$, of resistive sheet 30, given by the effective length-to-effective width ratio of resistive sheet 30, i.e.:

$$\alpha_{eff} = \frac{L_{eff}}{W_{eff}}$$

Thus, the effective alpha depends on both the current density distribution along the length of resistive sheet 30 and the current density distribution along the width of resistive sheet 30. By reducing the effective alpha function, $\alpha_{eff}$, of resistive sheet 30, it is possible to reduce loss resistance 22 of resistive sheet 30, which increases the radiation efficiency, e, of resistive sheet 30.

Because of the inherent losses of resistive sheet 30, regions of resistive sheet 30 having high concentration of current density will cause larger ohmic losses, degrading the antenna radiation efficiency of resistive sheet 30. Thus, where resistive sheet 30 is intended to minimize losses and maximize radiation efficiency, a current density uniformly flowing over the entire area of resistive sheet 30 is preferable. In addition, both RF current "hot spots" and RF current "pinch points" must be avoided, particularly at edges, corners, or narrower regions of resistive sheet 30 in which high concentration of RF currents may occur.

Therefore, most preferably, a peripheral boundary, enclosing an area of said resistive sheet 30 layer, defines a topology designed to carry a desired current density that uniformly and smoothly flows over the entire area of resistive sheet 30. Accordingly, the topology of resistive sheet 30 is typically configured to have rounded instead of sharp corners or to be larger in dimensions, as compared to a counterpart made of conductive material, to avoid abrupt disruption of currents and allow currents to naturally decay to levels that may not create significant losses at the edges of resistive sheet 30.

Figure 3:
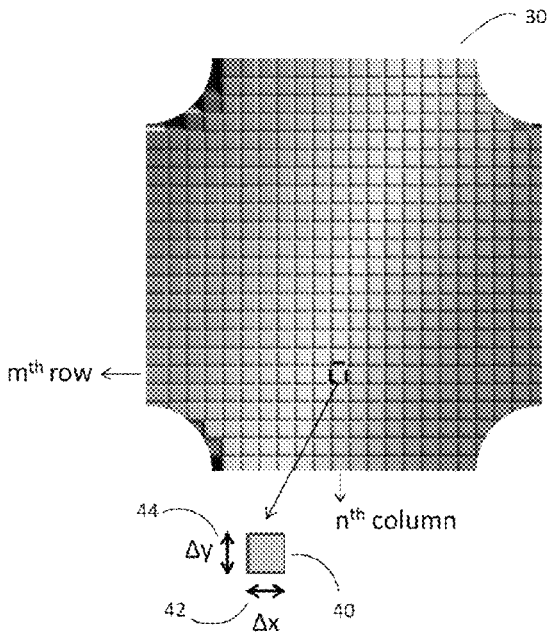
FIG. 3 is a representation of FIG. 2 showing a discretization into pixels of the resistive sheet.

FIG. 3 shows a discretization into pixels of resistive sheet 30. A pixel 40 is a discretized element of resistive sheet 30 representing a smaller area of a total area of resistive sheet 30. A gray tonality in pixel 40 represents a magnitude of the current density flowing on pixel 40 of resistive sheet 30. A size of pixel 40 is selected to have a maximum length 42 and a maximum width 44. Maximum length 42 of pixel 40 is smaller than maximum length 36 of resistive sheet 30. Maximum width 44 of pixel 40 is smaller than maximum length 36 of resistive sheet 30. For computational convenience, a generally square geometrical shape may be preferred for pixel 40 of resistive sheet 30. However, selecting a square pixel 40 is not always possible due to the shape irregularities of resistive sheet 30 and the selected dimensions of pixel 40, as can be seen in FIG. 3 around the curved edges of resistive sheet 30. In general, the shape of each pixel 40 of resistive sheet 30 can have any geometrical shape. Those skilled in the art will recognize that maximum length 42 of pixel 40 and maximum width 44 of pixel 40 are typically selected to be equal or smaller than a tenth of a wavelength, at the lowest frequency of operation in the medium where resistive sheet 30 is located. However, other sizes of maximum length 42 of pixel 40 and maximum width 44 of pixel 40 may be selected.

Referring to the coordinate system shown in FIG. 2, an alpha function in Y-axis 34 direction, of pixel 40 located at the m-th row and the n-th column of discretized resistive sheet 30, as depicted in FIG. 3, can be defined as:

$$\alpha_y^{mn} = \frac{\int_0^{\Delta y} D(y)^2 dy}{\int_0^{\Delta x} B(x)^2 dx}$$

where D(y) is the normalized current density distribution within pixel 40 of resistive sheet 30 in Y-axis 34 direction, and B(x) is the normalized current density distribution within pixel 40 of resistive sheet 30 in X-axis 32 direction for current flowing along Y-axis 34 direction.

Likewise, an alpha function in X-axis 32 direction, of pixel 40 depicted in FIG. 3, located at the m-th row and the n-th column of discretized resistive sheet 30, can be defined as:

$$\alpha_x^{mn} = \frac{\int_0^{\Delta x} B(x)^2 dx}{\int_0^{\Delta y} D(y)^2 dy}$$

Therefore, for resistive sheet 30 operating as an antenna element and having a sheet resistivity, Rs, the loss resistance 22 within pixel 40 can be written as:

$$Ro_y^{mn} = Rs\alpha_y^{mn}$$

$$Ro_x^{mn} = Rs\alpha_x^{mn}$$

where $Ro_y^{mn}$ and $Ro_x^{mn}$ are the loss resistance within pixel 40 of resistive sheet 30 in Y-axis 34 direction and X-axis 32 direction, respectively.

Thus, each pixel of resistive sheet 30 can be characterized by a first loss resistance in Y-axis 34 direction and a second loss resistance in X-axis 32 direction. Accordingly, the calculation of the overall effective alpha function, $\alpha_{eff}$, of resistive sheet 30, can then be determined by means of circuit theory methods well-known to those skilled in the art. Alternatively, the overall effective alpha function, $\alpha_{eff}$, of resistive sheet 30, having sheet resistance Rs, can be determined by calculating the antenna radiation efficiency, e, of resistive sheet 30 and the antenna radiation resistance of resistive sheet 30, using electromagnetic simulation software, such as Ansys-HFSS commercial software. Correspondingly, the topology of resistive sheet 30 may be adjusted to reduce the overall effective alpha function, $\alpha_{eff}$, according to the physical dimensions of resistive sheet 30 and the distribution of the current density flowing over resistive sheet 30.

Figure 4:
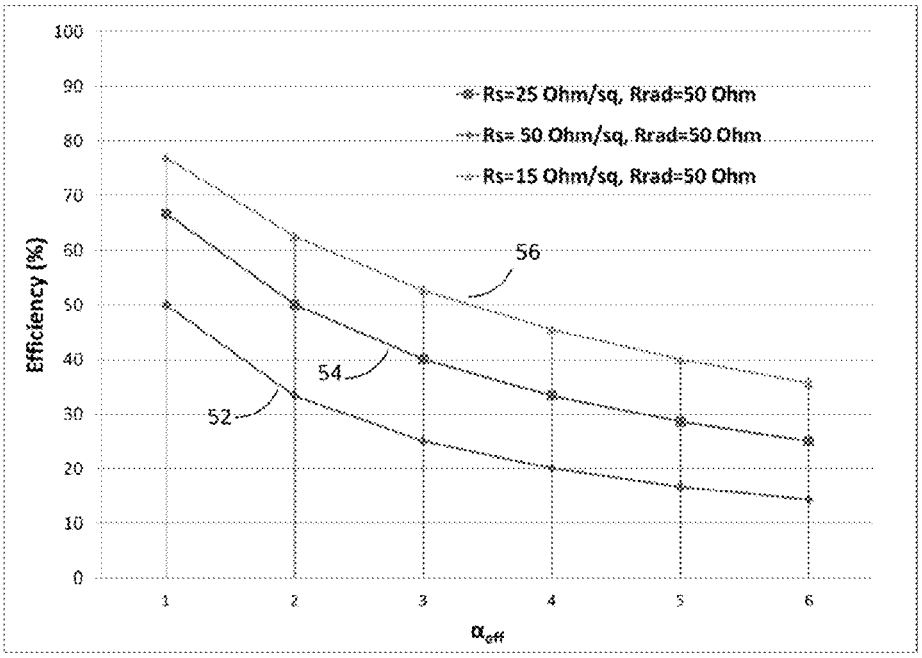
FIG. 4 shows a graph of antenna radiation efficiency, as a function of effective alpha, of a resistive sheet antenna having a radiation resistance of 50 Ohms for different values of sheet resistivity.

FIG. 4 shows a graph of an antenna radiation efficiency, as a function of an effective alpha, of a resistive sheet antenna having a radiation resistance of 50 Ohms for different values of sheet resistivity. This graph shows how the radiation efficiency of a resistive sheet antenna increases as the effective alpha function, $\alpha_{eff}$, decreases, because the antenna resistance loss becomes smaller. Particularly in FIG. 4, a solid-circle curve 52, a solid-square curve 54, and a solid-triangle curve 56 correspond to the antenna radiation efficiency mathematically calculated for an antenna using a resistive sheet material of 50-Ohm per square sheet resistivity, a 25-Ohm per square sheet resistivity, and a 15-Ohm per square sheet resistivity, respectively.

Figure 5:
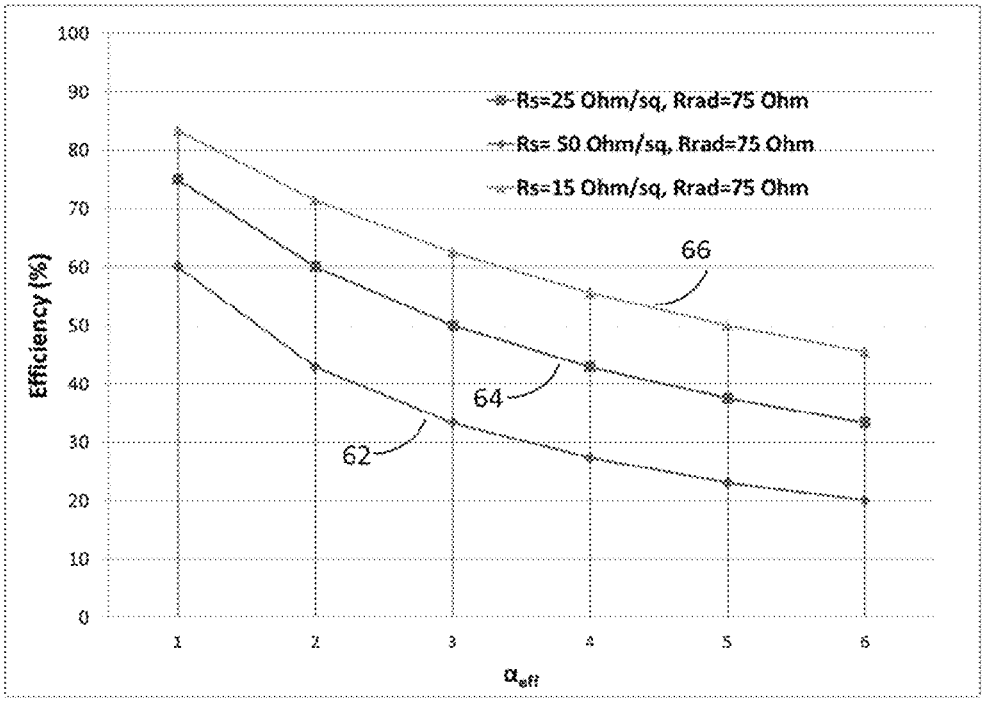
FIG. 5 shows a graph of antenna radiation efficiency, as a function of effective alpha, of a resistive sheet antenna having a radiation resistance of 75 Ohms for different values of sheet resistivity.

FIG. 5 shows a graph of an antenna radiation efficiency, as a function of an effective alpha, of a resistive sheet antenna having a radiation resistance of 75 Ohms for different values of sheet resistivity. This graph shows how the radiation efficiency of a resistive sheet antenna increases as the effective alpha function, $\alpha_{eff}$, decreases, because the antenna resistance loss becomes smaller. Particularly in FIG. 5, a solid-circle curve 62, a solid-square curve 64, and a solid-triangle curve 66 correspond to the antenna radiation efficiency mathematically calculated for an antenna using a resistive sheet material of 50-Ohm per square sheet resistivity, a 25-Ohm per square sheet resistivity, and a 15-Ohm per square sheet resistivity, respectively.

Figure 6:
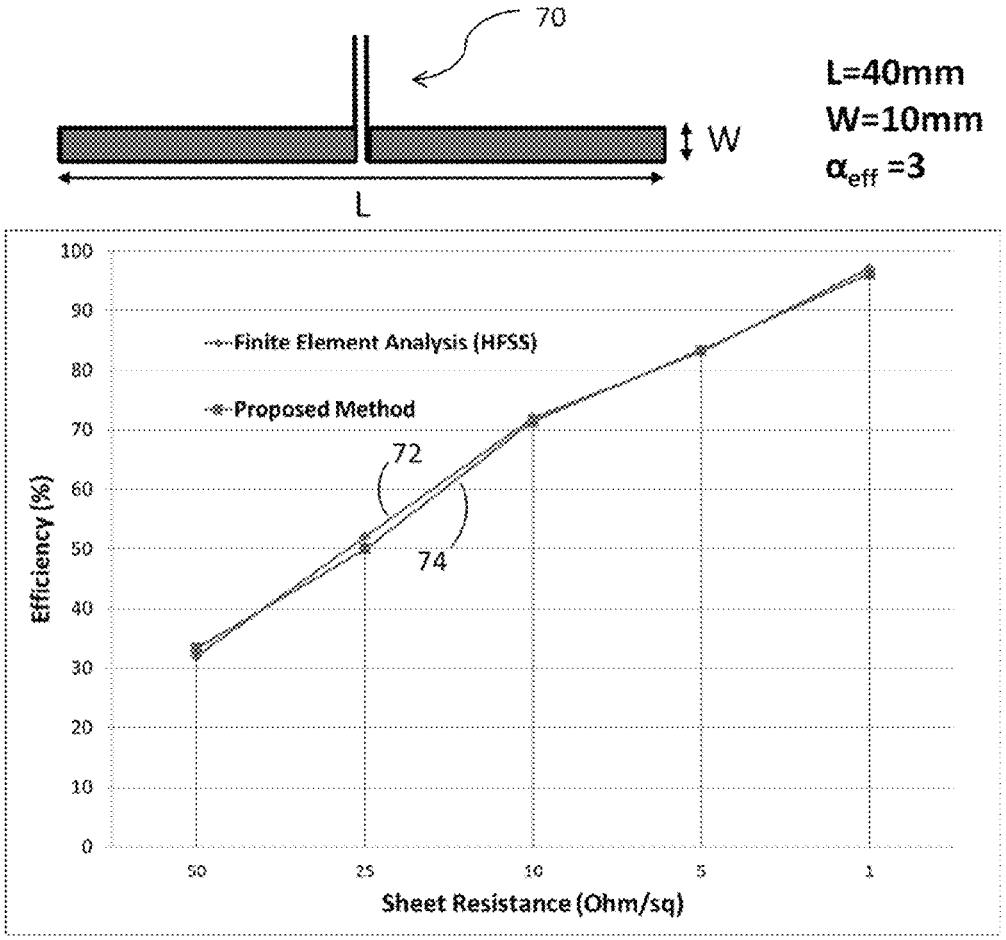
FIG. 6 shows a graph of antenna radiation efficiency, as a function of sheet resistivity, of a resistive sheet dipole antenna of 40-mm length and 10-mm width.

FIG. 6 shows a graph of an antenna radiation efficiency, as a function of sheet resistivity, of a resistive sheet dipole antenna of 40-mm length and 10-mm width. This graph represents a validation of a planar dipole-strip antenna 70 design using a resistive sheet material, having a 40-mm length and a 10-mm width. In FIG. 6, a solid-circle curve 72 corresponds to the antenna radiation efficiency calculated by a well-known commercially available electromagnetic software (Ansys-HFSS), for different values of sheet resistivity. Also, in FIG. 6, a solid-square curve 74 corresponds to the antenna radiation efficiency determined by using the effective alpha function, for different values of sheet resistivity. In this case, the computed value of the effective alpha function, $\alpha_{eff}$, is equal to 3. In FIG. 6 it is evident how close the results represented by curve 72 and curve 74 match. This matching is indicative of the validation of this antenna design using the effective alpha function introduced in our model.

Figure 7:
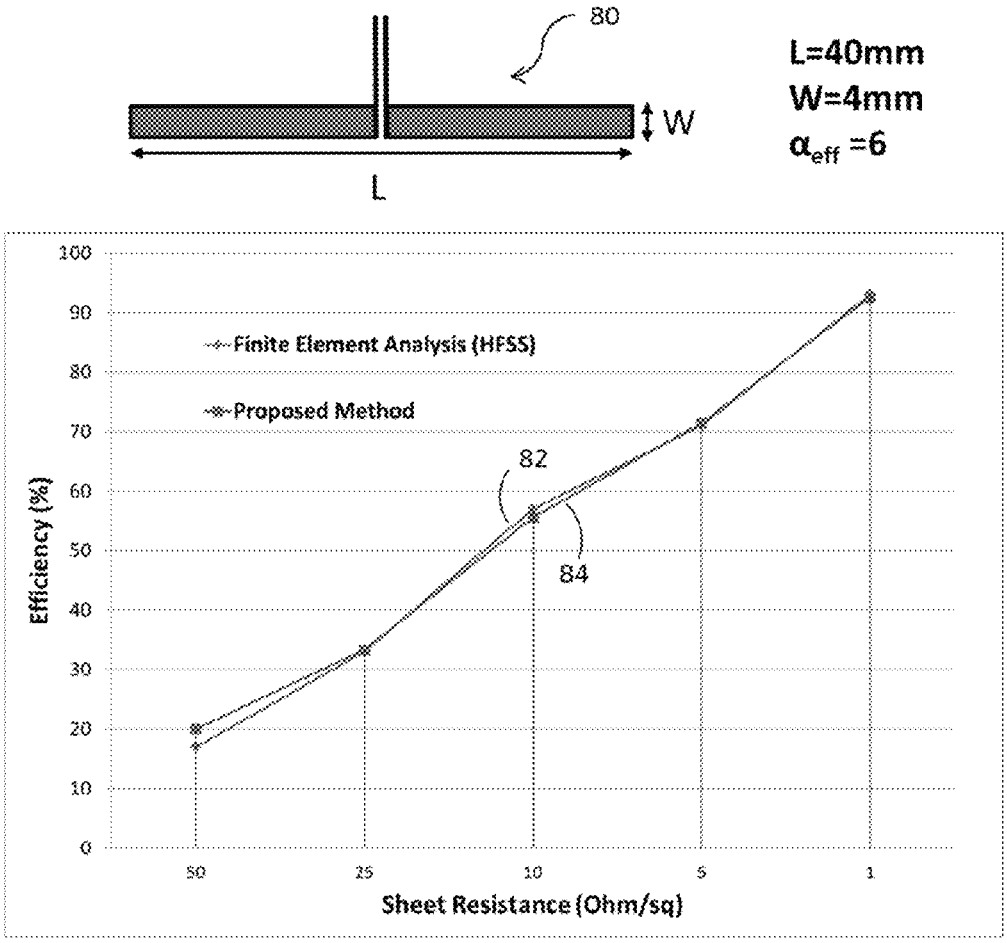
FIG. 7 shows a graph of antenna radiation efficiency, as a function of sheet resistivity, of a resistive sheet dipole antenna of 40-mm length and 4-mm width.

FIG. 7 shows a graph of an antenna radiation efficiency, as a function of sheet resistivity, of a resistive sheet dipole antenna of 40-mm length and 4-mm width. This graph represents a validation of a planar dipole-strip antenna 80 design using a resistive sheet material, having a 40-mm length and a 4-mm width. In FIG. 7, a solid-circle curve 82 corresponds to the antenna radiation efficiency calculated by a well-known and commercially available electromagnetic software (Ansys-HFSS), for different values of sheet resistivity. Also in FIG. 7, a solid-square curve 84 corresponds to the antenna radiation efficiency determined by using the effective alpha function, for different values of sheet resistivity. In this case, the computed value of the effective alpha function, $\alpha_{eff}$, is equal to 6. In FIG. 7 it is evident how close the results represented by curve 82 and curve 84 match. This is indicative of the validation of this antenna design using the effective alpha function introduced in our model.

The determination and use of an effective alpha function, $\alpha_{eff}$, for designing an antenna, using a resistive sheet, includes for each possible configuration of interest, taking into account the following considerations: first, the available area wherein the antenna would be located; second, the presence of resistive and conductive materials, including other antennas, within a radius of two wavelengths at the lowest frequency of operation in the medium wherein the antenna is operating; third, discretizing the area of the antenna into pixels having a maximum length and a maximum width no larger than a tenth of a wavelength at the lowest frequency of operation in the medium where the antenna is operating; fourth, determining the current density distribution on the antenna surface, corresponding to an excitation source in the presence of other resistive and conductive materials; fifth, normalizing the current density distribution on the antenna surface wherein the antenna lies; sixth, calculating the effective alpha function corresponding to each pixel into which the total area of the antenna has been discretized; seventh, creating an equivalent electrical circuit network, corresponding to the antenna surface, by means of the calculated effective alpha function corresponding to each pixel in the directions of a Cartesian coordinate system wherein the area of the antenna has been discretized; eighth, determining parameters of the equivalent electrical circuit network, particularly the resistance loss of the antenna, corresponding to the current density distribution on the antenna. Alternatively, the overall effective alpha function, $\alpha_{eff}$, can be determined by calculating the antenna radiation efficiency and the antenna radiation resistance of the antenna, by means of electromagnetic simulation software, such as Ansys-HFSS commercial software or other methods well-known by those skilled in the art; and ninth, adjusting the topology of the antenna to reduce the overall effective alpha function, $\alpha_{eff}$, according to the physical dimensions of the antenna and the distribution of the current density flowing over the resistive sheet. In particular, the topology of the antenna must avoid RF current "hot spots" and RF current "pinch points," by increasing the uniform distribution of currents flowing over said resistive sheet, at the frequencies of interest, as a result of implementing one or more of the following design considerations: increasing the area of the resistive sheet wherein the currents flow, reducing the sheet resistivity of the resistive sheet, and smoothing out the edges and avoiding sharp corners of the topology in regions wherein the currents flow.

Figure 8:
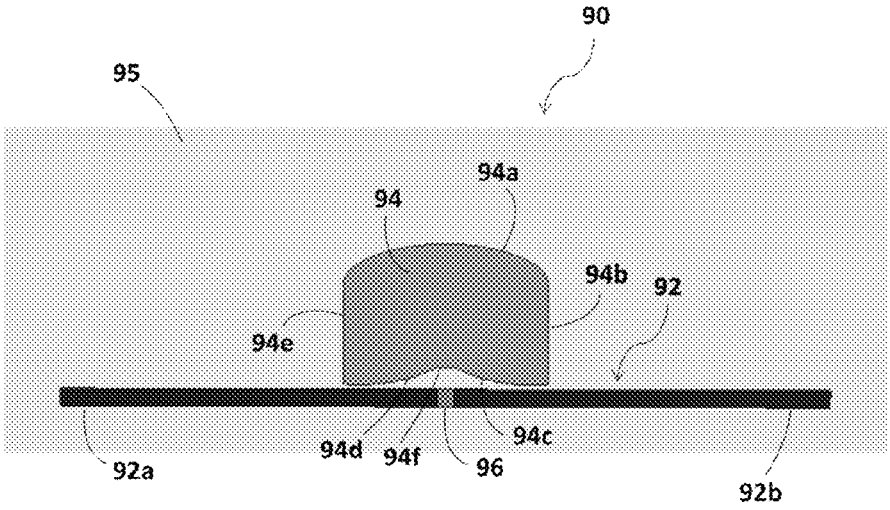
FIG. 8 shows an exemplary embodiment of a model of a planar dual-band dipole antenna system with a parasitic element made of a resistive sheet.

In accordance with certain aspects of an embodiment, FIG. 8 shows an exemplary configuration of a planar dual-band dipole antenna system 90, comprising a dipole antenna element 92 and a parasitic element 94. Dipole element 92 and parasitic element 94 are coplanar and both are disposed on a nonconductive substrate 95. Dipole antenna element 92 consists of a thin sheet made of conductive material, such as copper or silver, whereas parasitic element 94 consists of a thin sheet or thin layer made of a resistive film, comprising Indium tin oxide, having a sheet resistivity of approximately 10 Ohms per square.

Dipole antenna element 92 consists of a first arm 92*a* and a second arm 92*b* fed at feeding point 96, each arm having a length of about 21.5 mm and a width of 1 mm. Substrate 95 consists of a piece of glass with a relative dielectric permittivity of about 7, a tangent loss in the order of 0.05, and approximate dimensions of 50-mm in length, 24-mm in width, and 0.7-mm in thickness. Those skilled in the art will recognize that substrate 95 may be implemented using different varieties of glass, plastic, sapphire, and polymers such as polyethylene terephthalate (PET), having different thickness and tangent loss.

The length of arms 92*a* and 92*b* primarily defines a first lower frequency region of operation of antenna system 90. Likewise, the length of parasitic element 94 primarily defines a second higher frequency region of operation of antenna system 90. Those skilled in the art will realize that there are a variety of ways to feed dipole element 92, including by means of an electromagnetically-coupled feeding element, a coaxial cable, a coplanar waveguide or other types of transmission line known in the prior art.

Parasitic element 94 has a shape with a footprint that fits within a rectangle of approximately 11.7-mm in length and about 8-mm in width. Parasitic element 94 consists of a modified rectangle having a convex side 94*a*, elliptically shaped according to an ellipse with a major axis of 4.8 mm and a major-to-minor axes ratio of 2.45; a concave side, opposing said convex side 94*a*, consisting of a first edge 94*c*, a second edge 94*d*, and a third edge 94*f*; and two substantially parallel and opposing sides 94*b* and 94*e*, each with an approximate dimension of 5.6 mm. Edge 94*f* of parasitic element 94 has a length of approximately 1 mm and is positioned equidistant from sides 94*b* and 94*e*. Moreover, edge 94*c* and edge 94*d* of parasitic element 94 each follow an elliptical shape according to an ellipse with a major axis of 6 mm and a major-to-minor axes ratio of 2. In other words, edge 94*c* and edge 94*d* of parasitic element 94 each extend elliptically inward from sides 94*b* and 94*e* to define a midpoint notch that corresponds to edge 94*f*.

Parasitic element 94 is placed adjacent to dipole antenna element 92 without physically touching each other. Instead, parasitic element 94 electromagnetically couples to dipole antenna element 92 to ultimately characterize a performance of antenna system 90. In particular, an input impedance, a polarization characteristic and a frequency range of operation of antenna system 90 are influenced by the topology of parasitic element 94, in terms of the physical dimensions, configuration, and location of parasitic element 94. In this case, parasitic element 94 is positioned with a minimum separation from dipole element 92 of about 0.1 mm. Accordingly, dipole element 92 acts as a driver element or feeding element of parasitic element 94 by means of electromagnetic coupling.

In this embodiment, the topology of parasitic element 94 is configured to increase a uniform flow of RF currents on parasitic element 94 and to avoid RF current "hot spots" in order to increase the antenna radiation efficiency of antenna system 90. Particularly, parasitic element 94 is wider than traditional parasitic element designs using conductive materials; has two rounded corners at the joint of side 94*a* with side 94*b* and at the joint of side 94*a* with side 94*e*; has one smoothed, convex side 94*a*; and has one smooth, concave side formed by edges 94*c*, 94*d*, and 94*f*.

Moreover, dipole element 92 is excited such that the RF current is maximum at feed point 96 and gradually reduces to a zero level at a distance from feed point 96 corresponding to the location of sides 94*b* and 94*e* of parasitic element 94, at the intended frequency of operation of antenna system 90 primarily defined by parasitic element 94. Accordingly, parasitic element 94 is configured to reduce electromagnetic coupling at edge 94*f*, and to gradually increase electromagnetic coupling at edges 94*c* and 94*d* as edges 94*c* and 94*d* approach sides 94*b* and 94*e*, respectively. The location and physical configuration of edges 94*c*, 94*d*, and 94*f* and side 94*a* of parasitic element 94 allows a more uniform and smoother current density distribution on parasitic element 94 and avoids RF current "hot spots" to increase the antenna radiation efficiency of antenna system 90.

In this embodiment, side 94*b*, side 94*e*, the corner at the joint of side 94*b* with edge 94*c*, and the corner at the joint of edge 94*d* with side 94*e* of parasitic element 94 do not need to be smoothed out because the level of the nearby RF currents are significantly low at the intended frequency of operation, of antenna system 90, primarily defined by parasitic element 94.

Figure 9:
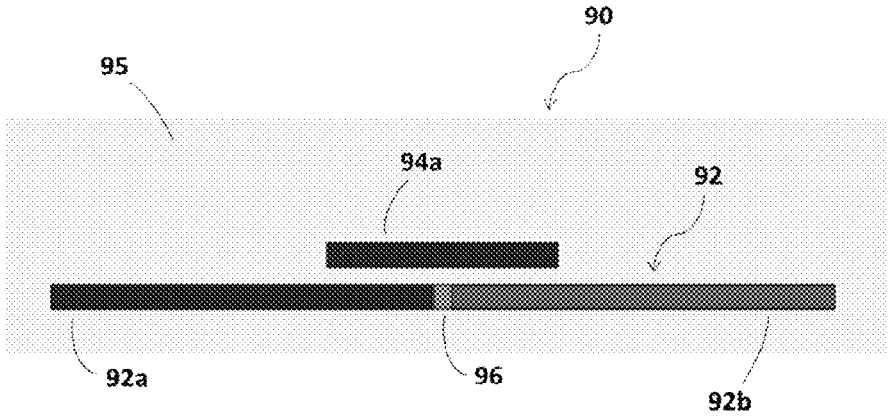
FIG. 9 shows a model of a planar dual-band dipole antenna system with a traditional parasitic element design made of a conductive material.
Figure 10:
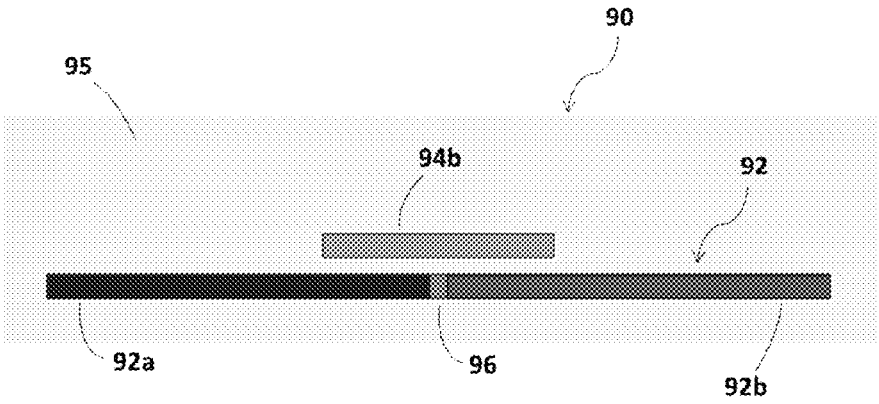
FIG. 10 shows a model of a planar dual-band dipole antenna system with a traditional parasitic element design made of a resistive sheet.
Figure 11:
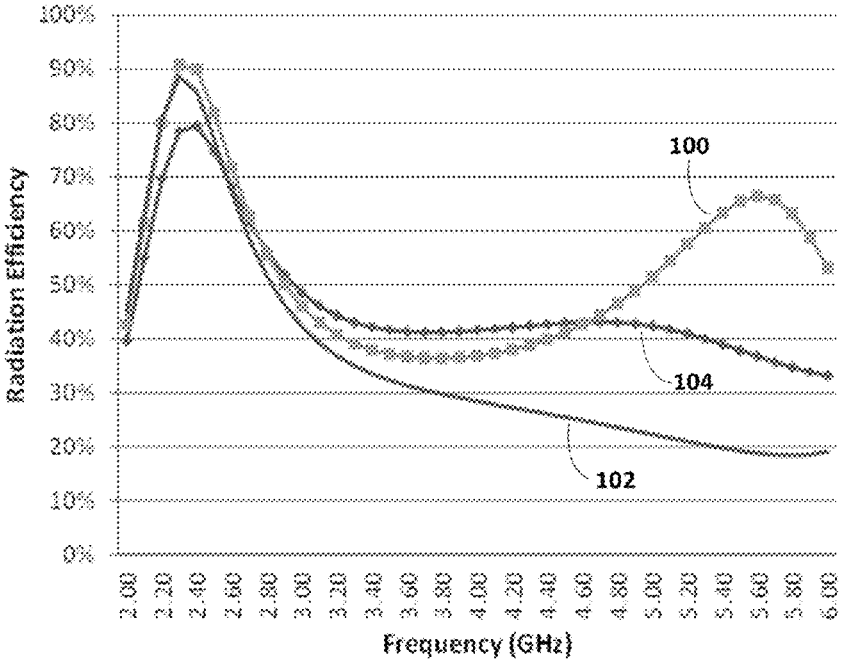
FIG. 11 shows a graph of antenna radiation efficiency, as a function of frequency, of different planar dual-band dipole antenna systems.

The effect of the topology of parasitic element 94 is better illustrated by referring to FIGS. 9 to 11. FIG. 9 shows a model of a planar dual-band dipole antenna system 90 comprising dipole element 92 and a parasitic element 94*a* using a typical design made of a conductive material. Dipole element 92 and parasitic element 94*a* are coplanar and both are disposed on nonconductive substrate 95. FIG. 10 shows a model of planar dual-band dipole antenna system 90 comprising dipole element 92 and a parasitic element 94*b*. Parasitic element 94*b* is designed using a typical design with a resistive layer having a sheet resistivity of approximately 10 Ohms per square. Likewise, dipole element 92 and parasitic element 94*b* are coplanar and both are disposed on nonconductive substrate 95. The dimensions and designs of parasitic elements 94*a* and 94*b* are identical. Moreover, the only difference between parasitic element 94*a* and parasitic element 94*b* is the type of material used to model parasitic element 94*a* (conductive material) and 94*b* (resistive layer with sheet resistivity of about 10 Ohms per square).

FIG. 11 shows a graph of antenna radiation efficiency, as a function of frequency, of the three different versions of planar dual-band dipole antenna system 90, corresponding to parasitic elements 94, 94*a*, and 94*b*. In these three cases, the antenna radiation efficiency of antenna system 90 has been calculated by a well-known commercial electromagnetic software (Ansys-HFSS). In FIG. 11, a solid-square curve 100 corresponds to the antenna radiation efficiency of planar dual-band dipole antenna system 90 with parasitic element 94*a*; a solid curve 102 corresponds to the antenna radiation efficiency of planar dual-band dipole antenna system 90 with parasitic element 94*b*; and a solid-diamond curve 104 corresponds to the antenna radiation efficiency of planar dual-band dipole antenna system 90 with parasitic element 94.

In FIG. 11, the solid-square curve 100 clearly shows two frequency regions of preferred operation. A first frequency region in the 2.2 GHz to 2.6 GHz range with antenna radiation efficiency approximately between 80% and 90%, and a second frequency region in the 5 GHz to 5.8 GHz frequency range with antenna radiation efficiency approximately between 50% and 67%. These two frequency regions of operation are indicative of the dual-band capability of antenna system 90 with parasitic element 94*a* and correspond to two key frequency bands for WiFi applications.

Also in FIG. 11, the solid curve 102 shows that the antenna radiation efficiency of antenna system 90 significantly reduces to values below 20%, within the 5 GHz to 5.8 GHz frequency range, when parasitic element 94*a* is replaced with parasitic element 94*b*. In other words, replacing the parasitic element made of conductive material with an identical element made of a resistive sheet of approximately 10 Ohms per square cuts by more than two and a half times the antenna radiation efficiency of antenna system 90. Moreover, the antenna radiation efficiency is reduced to levels below 25%, which is a typical minimum required value by industry standards for on-screen antennas for laptops and tablet applications. This drastic reduction in antenna radiation efficiency is indicative that traditional antenna design techniques based on conductive materials do not work when these materials are replaced with a resistive sheet.

However, in FIG. 11, the solid-diamond curve 104, shows that the antenna radiation efficiency of antenna system 90 can be maintained at levels approximately between 35% and 42%, within the 5 GHz to 5.8 GHz frequency range, when parasitic element 94*a* is replaced with parasitic element 94. Therefore, by configuring parasitic element 94*a* to the topology of parasitic element 94 in accordance with aspects of an embodiment of the invention, an increased uniform and smoother flow of RF currents on parasitic element 94 increases the antenna radiation efficiency of antenna system 90 to levels well above the minimum industry standards and significantly above the corresponding levels of a traditional design that just replace conductive material with a resistive sheet.

Figure 12:
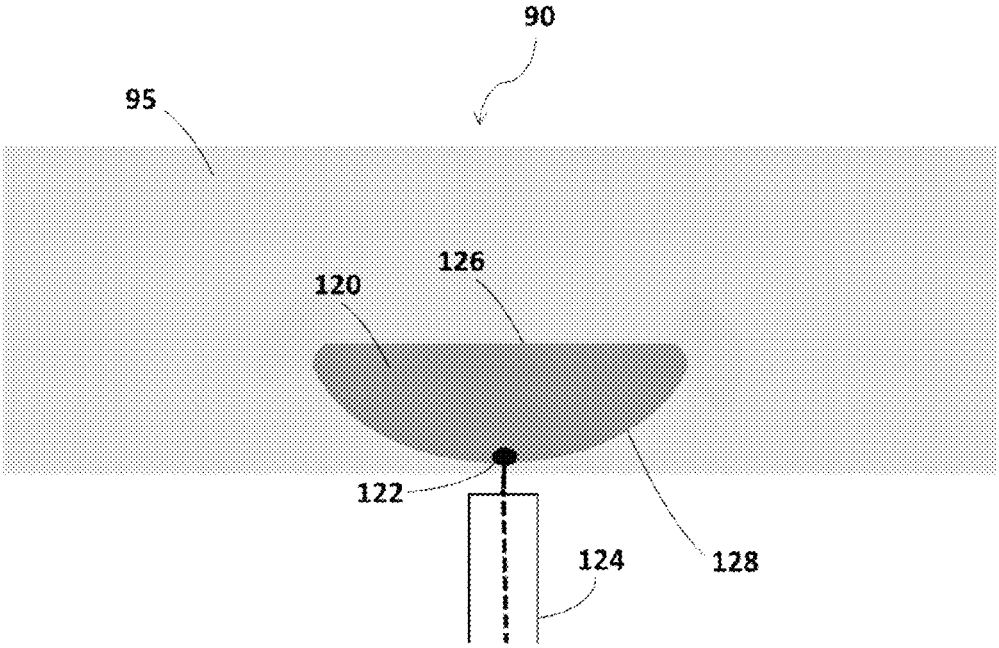
FIG. 12 shows a model of a planar semi-elliptical antenna in accordance with another embodiment.

FIG. 12 shows another exemplary configuration of antenna system 90 in accordance with aspects of an embodiment of the invention, comprising a resistive layer 120, consisting of a resistive Indium tin oxide-based film disposed on nonconductive substrate 95; a feeding element 122; and a transmission line 124, shown in FIG. 12 as a coaxial cable. The topology of resistive layer 120 has a semi-elliptical configuration, comprising a first edge 126, primarily having a linear shape, and a second edge 128, having an elliptical shape. Second edge 128 is elliptically shaped according to an ellipse with a major axis of 20 mm and a major-to-minor axes ratio of 1.15. Accordingly, first edge 126 and second edge 128 join at two regions, each defining a corner of resistive layer 120. Moreover, each corner of resistive layer 120 is shaped to follow an elliptical shape according to an ellipse of major axis 2.2 mm and a major-to-minor axes ratio of 1.05.

Resistive layer 120 is fed by feeding element 122, which is coupled to coaxial cable 124. Feeding element 122 consists of an approximately 1-mm radius circular pad, made of conductive material, electrically connected to the center conductor of coaxial cable 124. Preferably, feeding element 122 is attached to resistive layer 120 by means of a commercially available adhesive tape, because of inherent practical difficulties to solder directly into resistive layer 120. Furthermore, the conductive film used has a protective thin layer of polymer on each surface. Thus, effectively, the coupling of feeding element 122 to resistive layer 120 is primarily through electromagnetic coupling, even though feeding element 122 is in physical contact with the protective polymer layer of resistive layer 120.

In regards to the configuration shown in FIG. 12, simulation results of antenna system 90 show that a radiation efficiency in the order of 38% is achievable using a resistive sheet of 50 Ohms per square at a frequency of 3 GHz. Likewise, a radiation efficiency of approximately 50% is obtained when using a resistive sheet of 25 Ohms per square at a frequency of 3 GHz. As a way of comparison, a Copper-based antenna element provides a radiation efficiency of about 95%, whereas antennas designed using traditional antenna design techniques, using conductive antenna elements as opposed to resistive sheets, provide an antenna radiation efficiency below 10% at a frequency of 3 GHz. As a reference, typical industry standards of antenna systems used for mobile platform applications require a minimum antenna radiation efficiency of 30%. In other words, this configuration not only provides a substantially larger radiation efficiency, compared to antennas designed using resistive sheets based on traditional design techniques, but also meets typical industry standards.

Those skilled in the art will realize that other methods of implementing transmission line 124, in addition to using a coaxial cable, include a coplanar waveguide, a microstrip line and other types of transmission lines known in the prior art, any of which may be used without departing from the spirit and scope of the invention. Likewise, those skilled in the art will recognize that feeding element 122 may be implemented by using conductive adhesive, soldering a conductive terminal, or other types of electromagnetically-coupled feeding elements known in the prior art.

Alternatively, other forms of the configurations described herein may include a resistive sheet having a topology with at least one smooth edge and at least one smooth corner. In another configuration, the topology of a resistive sheet may be configured to reduce electromagnetic coupling to other resistive or conductive materials. In yet another configuration, the topology of a resistive sheet may be configured to have a shape as wide as possible, to have at least one region wide enough to avoid RF current "pinch points." Likewise, in any of the configurations described herein, a resistive sheet antenna may operate in an elliptical polarization, including a generally linear polarization and a generally circular polarization; in a single frequency band or multiple frequency bands; and as part of a single, diversity, multiple input multiple output (MIMO), reconfigurable or beam forming network system.

Those skilled in the art will realize that the resistive layer described in the different configurations of antenna system 90 may be implemented by means of a resistive film comprising a metal oxide compound, such as tin oxide, disposed on substrate 95, or by application of a resistive coating directly to substrate 95 or to a thin layer of a substrate such as polyethylene terephthalate to be disposed on substrate 95.

Figure 13:
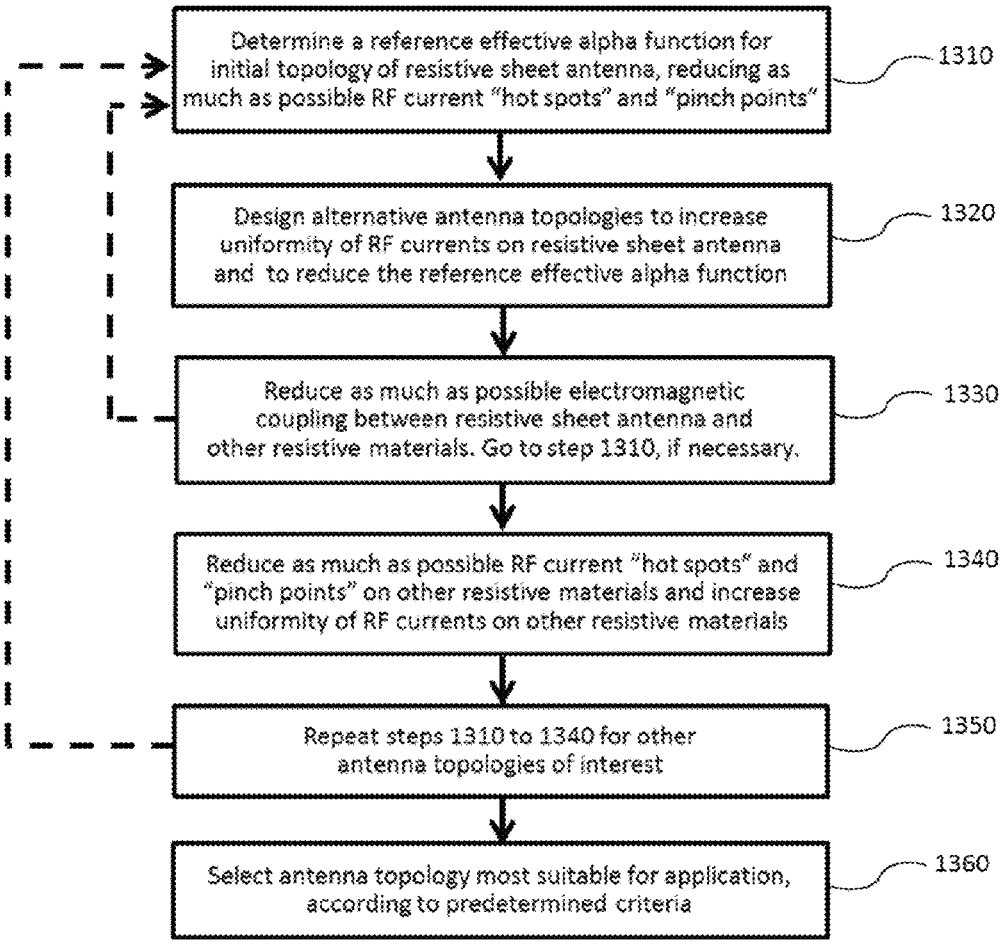
FIG. 13 shows a schematic view of a method for designing an antenna using a resistive sheet.

Regarding each of the above-described configurations, a method as depicted in FIG. 13 for designing an antenna topology, using resistive sheets of material or in the presence of other resistive material, and for setting up the antenna dimensional and operational parameters may be performed according to the following:

1. At step 1310, determining a reference effective alpha function, $\alpha_{eff}$, for the resistive sheet of an initial topology design of the antenna. In particular, the initial topology of the antenna must avoid RF current "hot spots" and RF current "pinch points," by increasing the uniform distribution of RF currents flowing over the resistive sheet, at the frequencies of interest.

2. Next, at step 1320, designing alternative antenna topologies of the antenna, wherein RF currents flow uniformly over as much area as possible of the antenna. This may include creating new topologies of the antenna or adjusting the initial topology of the antenna to reduce the reference effective alpha function, $\alpha_{eff}$, according to the physical dimensions of the antenna and the distribution of the current density flowing over the resistive sheet, as a result of implementing one or more of the following design considerations: increasing the area of the resistive sheet wherein the currents flow, reducing the sheet resistivity of the resistive sheet, and smoothing out the edges and avoiding sharp corners of the topology in regions wherein the currents flow.

3. Next, at step 1330, reducing, as much as possible, any electromagnetic coupling between the antenna and other materials within a radius of two wavelengths at the lowest frequency of operation of the antenna in the medium wherein the antenna is intended to operate. Go to step 1310, if necessary, to consider additional antenna topologies.

4. Next, at step 1340, reducing as much as possible RF current "hot spots" and RF current "pinch points" on the other resistive material, and increasing the uniform flow of RF currents over as much area of the resistive material as possible, in case that the electromagnetic coupling between the antenna and other materials cannot be totally eliminated. This may include reconfiguring the topology of the resistive sheet antenna to reduce the electromagnetic coupling between the resistive sheet antenna and the other resistive material.

5. Next, at step 1350, repeating steps 1310 to 1340 for other antenna topologies of interest.

6. Last, at step 1360, selecting an antenna topology most suitable for an intended application of the antenna, in terms of performance or other predetermined criteria.

Those of ordinary skill in the art will recognize that the steps above indicated can be correspondingly adjusted for specific configurations and other constraints, including operating frequency band and bandwidth, radiation gain, polarization, radiation efficiency, input impedance matching, operational conditions, surrounding environment, available area and location for implementation of the antenna, method of antenna feeding, and type of transmission line used for a given application.

Preferably, the uniformity of RF currents flowing over the resistive sheet, RF current "hot spots," RF current "pinch points," the electromagnetic coupling between two materials, the overall effective alpha function, $\alpha_{eff}$, and other antenna performance parameters, including but not limited to electromagnetic fields, radiation efficiency, currents, radiation gain, input impedance, and polarization are determined by means of a computer-assisted simulation tool and electromagnetic simulation software, such as Ansys-HFSS commercial software or other methods well-known by those skilled in the art.

Most preferably, a data processing and decision making algorithm may be implemented to analyze antenna parameters or calculate a figure of merit of the antenna performance, including but not limited to electromagnetic fields, radiation efficiency, currents, radiation gain, input impedance, and polarization, to support or guide the antenna design process as described herein, as those skilled in the art will realize. Alternatively, a resistive sheet antenna may be designed by determining and reducing the total effective alpha function or equivalently by increasing the radiation resistance of the antenna.

The various embodiments have been described herein in an illustrative manner, and it is to be understood that the terminology used is intended to be in the nature of words of description rather than of limitation. Any embodiment herein disclosed may include one or more aspects of the other embodiments. The exemplary embodiments were described to explain some of the principles of the present invention so that others skilled in the art may practice the invention. Obviously, many modifications and variations of the invention are possible in light of the above teachings. The present invention may be practiced otherwise than as specifically described within the scope of the appended claims and their legal equivalents.

We claim:

1. An antenna system comprising:

a substantially nonconductive substrate;

a resistive layer disposed on said substrate, a feeding element; and a transmission line coupled to said feeding element;

wherein said resistive layer has a topology defining a peripheral boundary enclosing an area of said resistive layer, wherein said resistive layer comprises a metal compound such that said resistive layer is partly electrically conductive; wherein said topology has at least one edge having a smooth configuration and a shape according to an elliptical function, said topology being configured to reduce a plurality of losses caused by a current density flowing within said area, by a sufficient extent so as to enable said resistive layer to radiate an electromagnetic signal with a radiation efficiency of between approximately 10% and 90%; wherein said resistive layer is adapted to be conformal to an area of said substrate; and wherein said topology is configured such that an input impedance at said feeding element substantially matches an input impedance of said transmission line coupled to said feeding element.

2. The antenna system of claim 1, wherein said peripheral boundary of said topology forms a shape that prevents RF current from converging to create a localized high current concentration.

3. The antenna system of claim 1, wherein said current density has a substantial uniform distribution over said resistive layer.

4. The antenna system of claim 1, wherein said resistive layer is substantially transparent to light.

5. The antenna system of claim 1, wherein said current density flows over a portion of said area, defined by said topology of said resistive layer, that is smaller than said area defined by said topology of said resistive layer.

6. The antenna system of claim 1, wherein said substrate is substantially transparent to light.

7. The antenna system of claim 1, wherein said resistive layer is electromagnetically coupled to said feeding element.

8. The antenna system of claim 1, further comprising a driving element, wherein said resistive layer is coupled to said driving element.

9. The antenna system of claim 1, wherein said resistive layer is disposed coplanar with respect to said feeding element.

10. The antenna system of claim 1, wherein said resistive layer is disposed non-coplanar with respect to said feeding element such that said antenna element is spaced from and not directly abutting said resistive layer.

11. The antenna system of claim 1, wherein said substrate is part of a touchscreen.

12. The antenna system of claim 1, wherein said resistive layer has a sheet resistivity of between 0.1 and 1000 Ohms per square.

13. A method for designing an antenna, comprising:

a. providing an antenna system, further comprising:
   a substantially nonconductive substrate;
   a resistive layer disposed on said substrate,
   a feeding element; and
   a transmission line coupled to said feeding element;

wherein said resistive layer has a topology defining a peripheral boundary enclosing an area of said resistive layer, wherein said resistive layer comprises a metal compound such that said resistive layer is partly electrically conductive; wherein said topology has at least one edge having a smooth configuration and a shape according to an elliptical function, said topology being configured to reduce a plurality of losses caused by said current density flowing within said area, by a sufficient extent so as to enable said resistive layer to radiate an electromagnetic signal with a radiation efficiency of between approximately 10% and 13 90%; wherein said resistive layer is adapted to be conformal to an area of said substrate; and wherein said topology is configured such that an input impedance at said feeding element substantially matches an input impedance of said transmission line coupled to said feeding element;

b. determining a reference effective alpha function for said topology, wherein said effective alpha function is related to a loss resistance of said resistive layer, to calculate a reference radiation resistance of said resistive layer, wherein said topology reduces as much as possible the convergence of RF current to create one or more areas of localized high current concentration on said resistive layer; and c. designing an alternative topology, having a corresponding alternative effective alpha function, to increase a uniform distribution of said current density flowing within said area of said resistive layer, and wherein said alternative effective alpha function is smaller in value than said reference effective alpha function.

14. The method of claim 13, wherein designing said alternative topology further comprises the step of reducing an existing electromagnetic coupling between said resistive layer and a different resistive material.

15. The method of claim 13, wherein designing said alternative topology further comprises the step of reducing a convergence of radiofrequency current creating a high density current concentration ("hot spot") on said different resistive material.

16. The method of claim 13, further comprising the step of designing a plurality of alternative designs of said topology.

17. The method of claim 16, further comprising the step of selecting a most suitable design of said topology from said plurality of alternative designs of said topology for an application, according to a predetermined criteria.

18. The method of claim 16, further comprising the step of using a computer-assisted tool to determine an antenna performance parameter used to devise an increase of said radiation efficiency of said resistive layer.

* * * * *